US005636753A

United States Patent [19]

Wilkinson et al.

[11] Patent Number: 5,636,753

[45] Date of Patent: Jun. 10, 1997

[54] STABILIZER FOR PLURAL DRUM STACKS

[76] Inventors: Dennis Wilkinson, 6698 Albert La., Idaho Falls, Id. 83401; Mark D. Shaw, 9820 Preston Trail West, Ponte Vedra Beach, Fla. 32082; Laurence M. Bierce, 105 Sandra Rd., Jacksonville, Fla. 32256; J. Tad Heyman, 11858 Olde Oaks Ct. North, Jacksonville, Fla. 32223

[21] Appl. No.: 405,359

[22] Filed: Mar. 16, 1995

[51] Int. Cl.[6] ..... A47F 5/00

[52] U.S. Cl. ..... 211/59.4; 211/73; 206/821

[58] Field of Search ..... 211/59.4, 72, 73, 211/74; 248/310, 346.4, 346.11; 206/821, 564

[56] References Cited

U.S. PATENT DOCUMENTS

| | | | |
|---|---|---|---|
| 1,760,309 | 5/1930 | Marrits | 211/59.4 X |
| 1,814,180 | 7/1931 | Nicholls | 206/821 X |
| 2,661,097 | 12/1953 | Paul | 211/74 |
| 2,822,096 | 2/1958 | Buratovich | 206/821 X |
| 3,250,564 | 5/1966 | Stern et al. | 206/821 X |
| 3,317,087 | 5/1967 | Landis | 206/821 X |
| 3,422,564 | 1/1969 | Izumi | 206/821 X |
| 3,664,497 | 5/1972 | Mascia | 211/74 X |
| 4,116,332 | 9/1978 | Hartley | 206/821 X |
| 4,228,897 | 10/1980 | Underwood | 206/821 X |
| 4,436,216 | 3/1984 | Chang | 248/346.11 X |
| 4,582,447 | 4/1986 | Itoh | 206/821 X |
| 4,593,818 | 6/1986 | Schenkman | 206/821 X |
| 4,726,553 | 2/1988 | Wischusen, III | 248/346.11 X |
| 4,865,202 | 9/1989 | Day | 211/59.4 X |
| 5,016,761 | 5/1991 | Stoddard | 211/59.4 |
| 5,056,749 | 10/1991 | Ige | 248/346.11 |
| 5,090,871 | 2/1992 | Story et al. | 417/9 |
| 5,213,211 | 5/1993 | Umiker | 206/821 X |
| 5,246,113 | 9/1993 | Schuster | 206/821 X |
| 5,273,182 | 12/1993 | Laybourne | 248/310 X |
| 5,465,891 | 11/1995 | Bridges | 248/346.11 X |

FOREIGN PATENT DOCUMENTS

| | | | |
|---|---|---|---|
| 145936 | of 1920 | United Kingdom | 211/59.4 |

*Primary Examiner*—Robert W. Gibson, Jr.
*Attorney, Agent, or Firm*—Thomas C. Saitta

[57] ABSTRACT

A stabilizing device for plural drum stacks comprising a relatively planar web member having a plurality of annular drum retaining rings extending from both sides of said web member, the retaining rings adapted to fit within the rims of the drums being stacked to align and stabilize the vertical columns of drums. In the preferred embodiment, the retaining rings comprise bevelled shoulders for easy placement of the drums on the rings.

22 Claims, 2 Drawing Sheets

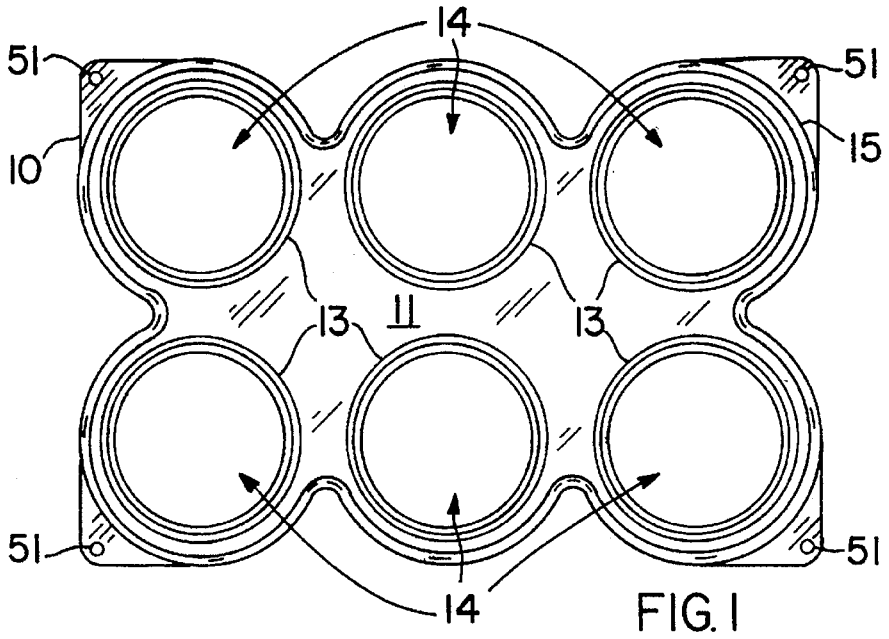
FIG. 1
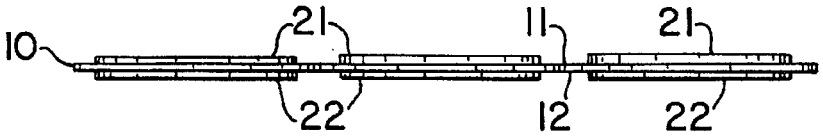
FIG. 2
FIG. 5
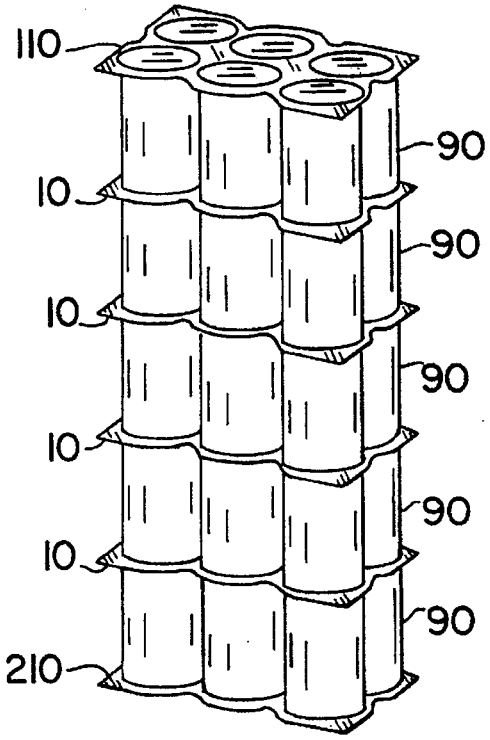

STABILIZER FOR PLURAL DRUM STACKS

BACKGROUND OF THE INVENTION

This invention relates generally to the field of spacing or stabilizing devices used to control and immobilize vertical stacks of large objects. More particularly, the invention relates to a stabilizer for use with large cylindrical containers having annular rims on each end, such as drums or barrels.

In circumstances where large numbers of objects must be stored, it is desirable to maximize the number of objects per square foot of storage space by stacking the objects vertically. For objects with rectilinear configurations, such as boxes or crates, this is relatively easy since the objects can be stacked directly on top of each other in a relatively stable manner. For odd shaped objects this is not possible, and the objects must be placed onto pallets or encased in crates or boxes to allow stable vertical stacking. A common storage container is the 83, 55 or 30 gallon drum, which is cylindrical with an annular rim extending from a flat top and another annular rim extending from a flat bottom. These drums cannot be stacked directly on top of each other in a stable manner, especially plural numbers in a single vertical column, because of the difficulty of aligning the rims.

Because of the ubiquitousness of these drum containers, vertical stacking for storage is very useful and often necessary. The simple solution is to position flat members or pallets between the drums, either between single drums or multiples on a given stacking level. This solution is not universally suitable since there are many instances where the weight of the loaded drums overcomes the support limits of the pallets. Additionally, the flat members or pallets do nothing to secure or stabilize the drums laterally, such that off-axis vertical loading of single drum columns or unbalanced weight for multiple drum levels can destabilize the column or stack and cause it to fall. Furthermore, some drum storage situations are subject to vibrations from machinery, traffic or even seismic movement, which can cause the drums to shift laterally and fall if the drums are not secured by strapping or connecting them to fixed support structures. Secure and stable vertical stacking of drums is of special concern where the drums are used for storage of hazardous materials such as chemicals, petroleum waste products and nuclear waste products, and strict regulations have been enacted to limit vertical stacking unless minimal load and stability conditions are met.

It is an object of this invention to provide a drum stabilizing member for use in vertical columns which properly aligns each drum relative to the drum below to insure that each rim is positioned directly above the rim of the adjacent drum, which secures the drums laterally as well as vertically to prevent any horizontal movement by either individual drums or groups of drums, which provides non-compressible vertical support about the entire drum rim to insure that each single drum vertical column shares a common central axis with no slanting of individual drums, and which interlocks and secures multiple vertical drum columns to form a stable integral combination of stabilizing members and drums.

SUMMARY OF THE INVENTION

The invention is a stabilizing device for plural drum stacks, the device comprising a relatively planar web member having a top side and a bottom side, with a plurality of annular drum rim retaining rings extending from one or both sides of the web member. Preferably the retaining rings each define a circular opening in said web member. The single sided web member is for use as the bottom or top stabilizing device in a stacking situation. For the double sided web members, each retaining ring comprises an upper positioning member and a lower positioning member, with each positioning member having an outer edge, and preferably an inner edge as well, with the outer edge preferably comprising a bevelled alignment member and a detent shoulder generally perpendicular to the top or bottom surface of the web member. The device is composed of a high strength, non-compressible, non-elastic, rigid material which preferably has low porosity and high resistivity to chemical attack or other forms of degradation, such as certain thermoset polymer materials. The retaining rings are sized such that the outer diameter of the detent shoulder mates with the inner diameter of the rim of the particular drum size being vertically stacked, preferably allowing for less than 1/16th inch of movement between the rim and the detent shoulder. The web member may include receiving members for attachment of additional structural alignment or rigidity means, such as for example apertures to receive poles of sufficient length to align plural web members. The web member may also include web member joining means on or adjacent to its perimeter to allow two web members to be joined together laterally to increase the number of drums stabilized on each stacking level.

BRIEF DESCRIPTION OF THE DRAWINGS

FIG. 1 is a top view of the invention, which is identical to the bottom view of the invention.

FIG. 2 is a side view of the invention.

FIG. 5 is a perspective view showing a multi-level stack of drums in combination with a plural number of the invention.

DETAILED DESCRIPTION OF THE INVENTION

Figure 3:
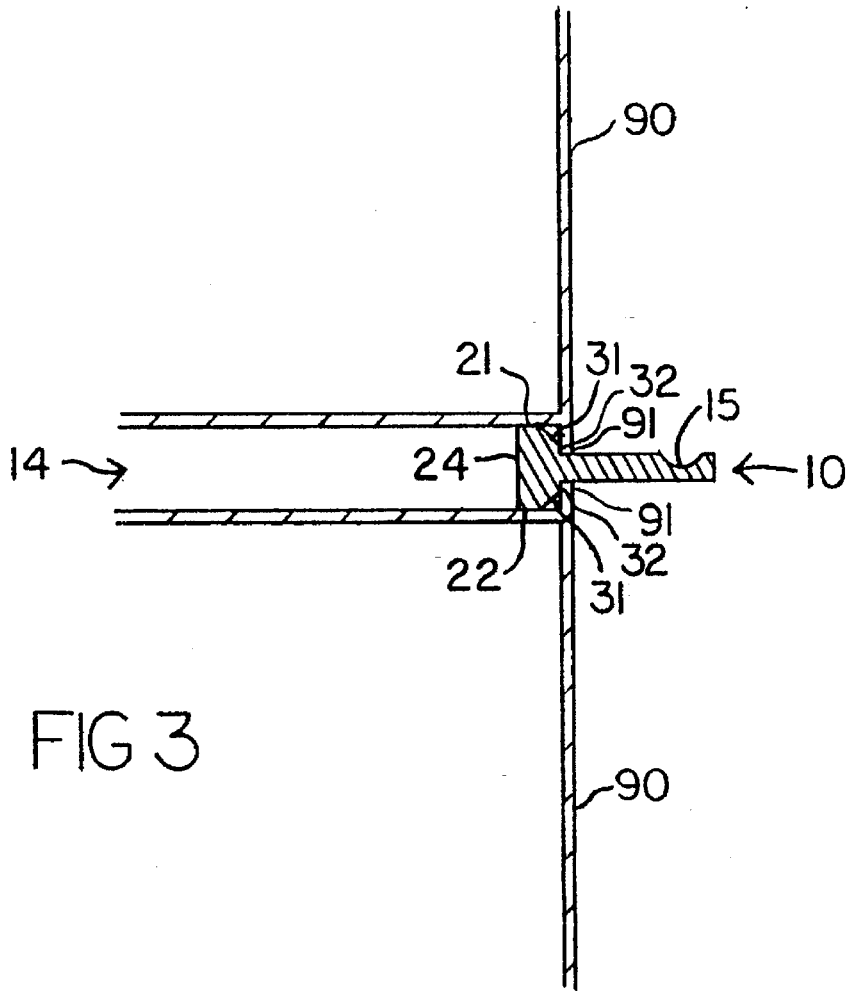
FIG. 3 is a cross-sectional side view of the invention taken along the line III—III of FIG. 1, showing two drums retained.

With reference to the drawings, the invention will now be described in detail with attention to the best mode and preferred embodiment. As seen in FIGS. 1 and 2, the invention is a stabilizing device comprising in general a web member 10 extending relatively extensively in length and depth with a small thickness dimension, the web member 10 having a top side 11, a bottom side 12, and a number of circular retaining rings 13, preferably defining openings 14 in web member 10. The device is shown with six retaining rings 13 in the figures, although it is to be understood that the device can be adapted for other numbers as well. Preferably the retaining rings 13 are equally spaced in sets in a linear manner as shown, but other placements may also be suitable. As shown in FIG. 5, the invention is used to stabilize plural numbers of vertical columns of drums 90. Interspersing a stabilizing device between each layer of drums 90 insures that the vertical columns are properly aligned, properly spaced, and securely retained in position even if external vibrations are encountered. The web member 10 may be generally rectangular in outer configuration, or excess material may be removed to better conform to the outer perimeter of the drum stack as shown in the drawings without sacrificing strength.

The stabilizer is composed of a high strength, non-compressible, non-elastic, rigid material, preferably having low porosity good resistivity against chemical attack, such as a thermoset polymer material. Preferably the material should exceed 4000 pounds in compression strength and exceed 1.5 times loading without deflection. For a six drum device as shown, overall dimensions of the web member 10 are approximately 87.5 inches by 58 inches, with a thickness of approximately 0.25 inches. The overall dimensions will of course vary depending on the particular number of retaining rings 13 present and the size of the particular drums 90.

Figure 4:
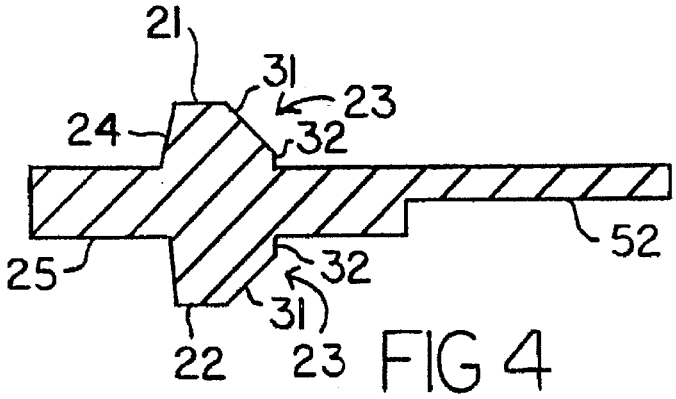
FIG. 4 is a cross-sectional side view similar to FIG. 3, showing an alternative construction for the inner edge of the retaining ring and an embodiment of the web member joining means.

Referring now to FIGS. 3 and 4, the structure of the retaining rings 13 is better illustrated. Each retaining ring 13 is a circular spacer or indexer for a vertically oriented pair of drums 90. The interior of each retaining ring 13 may be solid, or the material may be removed as shown to form circular openings 14 in the web member 10. Each retaining ring 13 has an outer edge 23, and if apertured an inner edge 24. The outer edge 23 is sized according to the particular size drum 90 being stabilized. For use with a 83 gallon drum, the retaining ring 13 will have an outer diameter of approximately 25.5 inches, which corresponds closely to the inner diameter of the annular rims 91. For use with a 55 gallon drum, the outer diameter will be approximately 22 inches, corresponding to the inner diameter of the rims 91 on this size drum 90. Preferably, there should be no more than 1/16 inches of clearance between the outer edge 23 of the retaining ring 13 and the interior of the drum rim 91 to prevent excessive travel by the drum 90 relative to the retaining ring 13.

As shown in FIG. 3, each retaining ring 13 is further comprised of an upper positioning member 21 on the top side 11 of web member 10 and a lower positioning member 22 on the bottom side 12 of web member 10. Thus each retaining ring 13 acts to position two drums 90, one below the web member 10 and the other above. The top rim 91 of the lower drum 90 abuts the outer edge 23 of the lower positioning member 22, while the bottom rim 91 of the upper drum 90 abuts the outer edge 23 of the upper positioning member 21. In this manner the two drums 90 are perfectly aligned along the vertical central axis, with each bottom rim 91 positioned squarely on each top rim 91 of the drum 90 below. Retaining ring 13 is preferably about 1.25 inches in total thickness, such that each of upper positioning member 21 and lower positioning member 22 extends approximately 0.5 inches from the top side 11 and bottom side 12 of web member 10, respectively. The drums 90 are thus prevented from moving or shifting laterally once they have been stacked. For the preferred stacking combination, a one-sided web member 210 is provided, the retaining ring 13 here comprising only upper positioning members 21. This construction creates a planar bottom side 12 to provide a solid, non-flexing foundation beneath the lowermost drums 90 in each column, while continuing to provide correct alignment and positioning to those drums 90. In the same manner, an uppermost web member 110 could also be created having only lower positioning members 22, since there would be no use at the top of the columns for upper positioning members 21.

In the preferred embodiment, as best shown in FIG. 4, the outer edge 23 of retaining ring 13 is comprised of a bevelled alignment member 31 and a detent shoulder 32. Alignment member 31 is preferably a 45 degree angled shoulder on the outer edges 23 of both upper positioning member 21 and lower positioning member 22 which meets the top of detent shoulder 32 a short distance above and below the top side 11 and bottom side 12 of web member 10. The alignment member 31 makes is easier to load drums 90 onto the retaining rings 13 since the initial clearance between the alignment member 31 and the rim 91 will be greater than the final clearance between the detent shoulder 32 and the rim 91. This feature is particularly important in nuclear waste storage scenarios, since the number of workers and their time of exposure to the materials must be kept to a minimum. The alignment member 31 allows a forklift operator to accurately stack the drums without need for an additional spotter. In embodiments where a circular opening 14 is incorporated within each retaining ring 13, it is further preferred to provide a stiffener member 25 to preclude lateral deflection of the opening 14 during load conditions. The stiffener member 25 can be an extension of the web member 10 a short distance inside the retaining rings 13 to form an inner rim. For example, the circular opening 14 would be sized to have an outer diameter ¾ inches smaller than the inner diameter of the retaining ring 13, creating a ¾ inch annular rim along the full inner perimeter of retaining ring 13.

The device as described sufficiently interlocks drums 90 such that secure, stabilized drum stacks four or five levels high can be created which satisfy the current Department of Energy nuclear waste stability standards. Currently only stacks up to three levels high are acceptable. The combination of the plural stabilizer devices and multiple vertical stacks maintains precise vertical alignment of each vertical column of drums 90 individually and precludes any lateral movement by drums 90 relative to the drums 90 above, below or to its side because of the retaining rings 13 and connecting material of web member 10. To further insure lateral stability, receiving members 51, shown as circular apertures in FIG. 1, can be incorporated to receive vertical structural posts or rods to join the plural levels.

In another embodiment, individual web members 10 can further comprise web joining means 52 to enable two web members 10 to be joined laterally to increase the number of vertical stacks interlocked by the invention. Web joining means 52 can be a recess in one web member 10 to allow a corresponding recess in another web member 10 to be adhesively or mechanically, as shown in FIG. 4, or can be any suitable configuration which allows more than one web member 10 to be joined to another by any known mechanical, chemical or other means.

In still another preferred embodiment, the web members 10 can further incorporate a retention groove or channel 15 which encircles the drums 90 near the perimeter of the web member 10. A leak detector device of any commonly known type responsive to the presence of liquid can be connected to this retention channel 15, such that any leakage from the drums 90 will set off an alarm or alert personnel in some manner.

We claim:

1. A stabilizing device for drum stacks, the device comprising a relatively planar web member and a plural number of annular drum retaining rings composed of a high strength, non-compressible, non-elastic, rigid material, said web member having a top side and a bottom side and said retaining rings extending from both said top side and said bottom side, each said retaining ring further comprising an upper positioning member and a lower positioning member each of which fit within the rim of a drum, each said upper positioning member and each said lower positioning member comprising an outer edge having a bevelled alignment member to properly position the drum during loading and a detent shoulder adjacent said web member to prevent lateral movement of the drum, where said bevelled alignment member is joined to said detent shoulder.

2. The device of claim 1, where said upper positioning member extends approximately 0.5 inches from said top side and where said lower positioning member extends approximately 0.5 inches from said bottom side.

3. The device of claim 1, where said bevelled alignment member is angled at approximately 45 degrees.

4. The device of claim 1, where each said retaining ring further comprises an inner edge defining a circular opening in said web member.

5. The device of claim 4, where said inner edge further comprises an annular stiffener member.

6. The device of claim 1, further comprising a number of apertured receiving members.

7. The device of claim 1, further comprising a retention channel adjacent the outer perimeter of said web member.

8. The device of claim 7, further comprising a leak detector connected to said retention channel.

9. An assembly for stabilizing drum stacks composed of side-by-side vertical columns of drums, the assembly comprising a number of stabilizing devices each comprising a relatively planar web member and a plural number of annular drum retaining rings composed of a high strength, non-compressible, non-elastic, rigid material, said web member having a top side and a bottom side and said retaining rings extending from both said top side and said bottom side, each said retaining ring further comprising an upper positioning member and a lower positioning member each of which fit within the rim of a drum, each said upper positioning member and each said lower positioning member comprising an outer edge having a bevelled alignment member to properly position the drum during loading and a detent shoulder adjacent said web member to prevent lateral movement of the drum, where said bevelled alignment member is joined to said detent shoulder, whereby said stabilizing devices are positioned horizontally between each of said drums in said vertical columns.

10. The assembly of claim 9, where said upper positioning member extends approximately 0.5 inches from said top side and where said lower positioning member extends approximately 0.5 inches from said bottom side.

11. The assembly of claim 9, where said bevelled alignment member is angled at approximately 45 degrees.

12. The assembly of claim 9, where each said retaining ring further comprises an inner edge defining a circular opening in said web member.

13. The assembly of claim 12, where said inner edge further comprises an annular stiffener member.

14. The assembly of claim 9, further comprising a number of apertured receiving members.

15. The assembly of claim 9, further comprising a retention channel adjacent the outer perimeter of said web member.

16. The assembly of claim 15, further comprising a leak detector connected to said retention channel.

17. The assembly of claim 9, further comprising a stabilizing device having retaining rings extending only from said top side of said web member.

18. The assembly of claim 17, further comprising a stabilizing device having retaining rings extending only from said bottom side of said web member.

19. The device of claim 1, further comprising receiving members in said web member for joining said device to other similar devices in a vertical manner.

20. The device of claim 1, further comprising web joining means for joining said device to other similar devices in a horizontal manner.

21. The assembly of claim 9, further comprising receiving members in said stabilizing devices for securing said stabilizing devices in a vertical manner.

22. The assembly of claim 9, further comprising web joining means in said stabilizing devices for joining said stabilizing devices to other stabilizing devices in a horizontal manner.

* * * * *